US006900759B1

(12) United States Patent
Katayama

(10) Patent No.: US 6,900,759 B1
(45) Date of Patent: May 31, 2005

(54) TERMINAL EQUIPMENT OF GOLF PLAY INFORMATION AND ANALYZING SYSTEM THEREOF

(76) Inventor: Muneomi Katayama, 1-12 Wakaba, Shinjuku-ku, Tokyo (JP), 160-0011

( * ) Notice: Subject to any disclaimer, the term of this patent is extended or adjusted under 35 U.S.C. 154(b) by 395 days.

(21) Appl. No.: 09/592,113

(22) Filed: Jun. 12, 2000

(30) Foreign Application Priority Data

Jul. 27, 1999 (JP) ..... 11-212753

(51) Int. Cl.[7] ..... H04B 7/185; G01C 21/26

(52) U.S. Cl. ..... 342/357.08; 342/357.01; 342/357.11; 701/213

(58) Field of Search ..... 710/100, 305; 701/213; 342/357.08

(56) References Cited

U.S. PATENT DOCUMENTS 4,666,156 A * 5/1987 Wakisaka ..... 434/152
4,791,249 A * 12/1988 Santoro ..... 178/18
5,636,872 A * 6/1997 Gamer et al. ..... 283/49
6,263,279 B1 * 7/2001 Bianco et al. ..... 701/213
6,278,402 B1 * 8/2001 Pippin ..... 342/357.08

* cited by examiner

*Primary Examiner*—Tim Vo
(74) *Attorney, Agent, or Firm*—Reed Smith LLP; Stanley P. Fisher, Esq.; Juan Carlos A. Marquez, Esq.

(57) ABSTRACT

A portable terminal is used so as to provide play results of a golf player and information necessary for the golf player wherein the golf player inputs a score into the portable terminal and thus necessary information and play results are directly provided from the portable terminal to the golf player.

16 Claims, 3 Drawing Sheets

TERMINAL EQUIPMENT OF GOLF PLAY INFORMATION AND ANALYZING SYSTEM THEREOF

BACKGROUND OF THE INVENTION

1. Field of Invention

The present invention relates to a hand held terminal equipment of golf play information and an analyzing system thereof in which a golf player carries a terminal equipment main body when the player plays golf and inputs information such as scores into the terminal equipment main body so that the terminal equipment can store play results therein and can feed back necessary information to the golf player.

2. Description of the Related Art

Golf has been popular among young and old of both sexes. In order to record golf scores, a golf player conventionally has written scores on a portable sheet. However, the player has frequently made mistakes in writing scores.

In addition, since only scores are written, the play results state only in figures such as "par" and "eagle". Therefore, there are disadvantages to having only this limited information in that it is difficult to grasp how a golf course is captured and where on the course a bad shot was made.

SUMMARY OF TE INVENTION

An object of the present invention is to eliminate the above disadvantages and to provide an input means of golf scores and an output means, and to directly provide information which serves as a reference for improving a player's skill to the player, such that the player's interest will be greatly enhanced.

A first aspect of the invention is that when playing golf, a golf player carries a terminal equipment main body and inputs and store a score and other necessary data into the terminal equipment main body using an input member such as an electronic pen so that information necessary for future play can be returned as analyzed results to the golf player.

Further, another aspect is that the data collected by the player is are collectively managed and edited so as to be capable of objective analysis.

Still another aspect is that the collectively managed and analyzed data can be provided to a player who is in a remote place by using a movement analyzing system and the world wide web (www).

The present invention has the following effects.

A golf player carries the terminal equipment, main body and inputs play results electronically thereinto. As a result, compared with a conventional card, a mistake in writing is eliminated and thus the recording operation is easy and certain.

A layout of a course shown on the terminal equipment main body is seen so that capture and strategy on the course can be planned easily.

The terminal equipment main bodies carried by respective players in a team or in several parties are managed collectively by a cradle main body, and the data in the terminal equipment main bodies are edited by the computer main body. As a result, the ranking and scores of all the members in the party can be outputted at real time by the output mechanism so that the operation is very accurate and efficiently.

The golf player draws a trajectory of a shot ball, a state of the ball and the like on the layout displayed on the terminal equipment main body during play, and this information is recorded into the computer main body.

As a result, the above data are captured onto the terminal equipment main body so that later the shot can be corrected at a next play.

In addition, the play results. (besides numerical values) as well as the layout of the course and the trajectory of the ball can be outputted by the output mechanism onto paper or onto an electronic means. As a result, these data can be useful to improve future play as a reference. These data can be received via Internet by using the www.

Further, the trajectory of a ball shot by a professional golf player, can be previously inputted as a good example of the capture on the course onto the layout displayed on the terminal equipment main body so that this can be a reference of the capture on the course and can greatly attract the interest of the player.

DETAILED DESCRIPTION OF THE PREFERRED EMBODIMENTS

Figure 1:
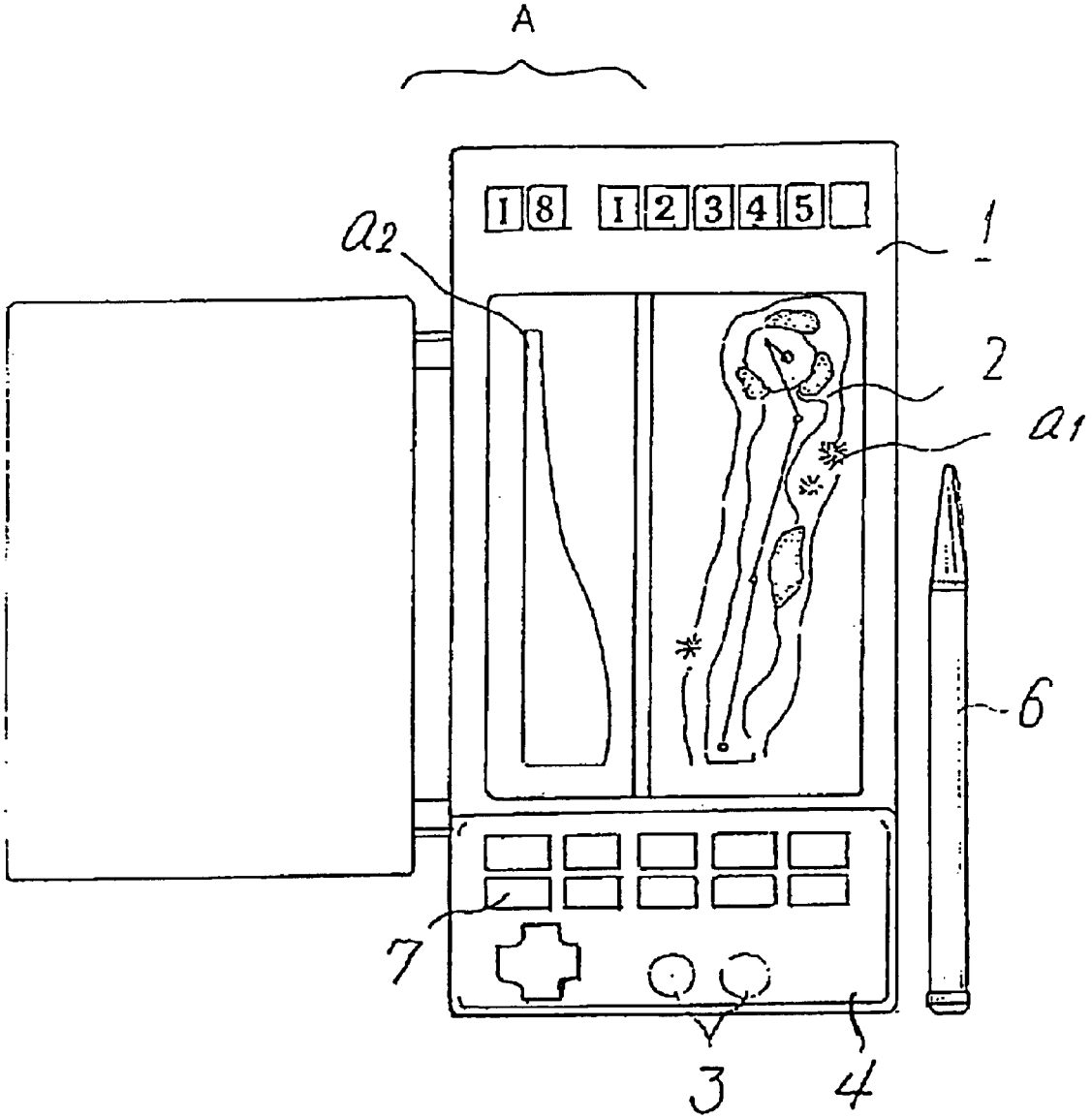
FIG. 1 is a front view of a terminal equipment main body.
Figure 2:
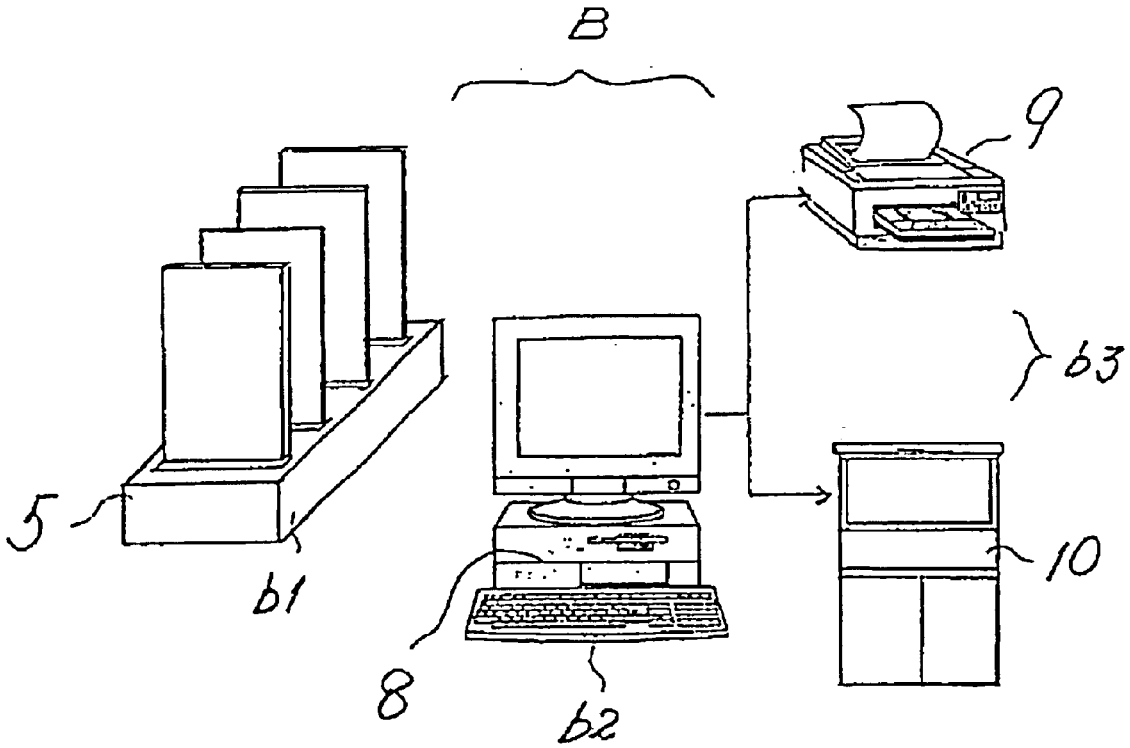
FIG. 2 is a schematic diagram showing a layout of an analyzing system.
Figure 3:
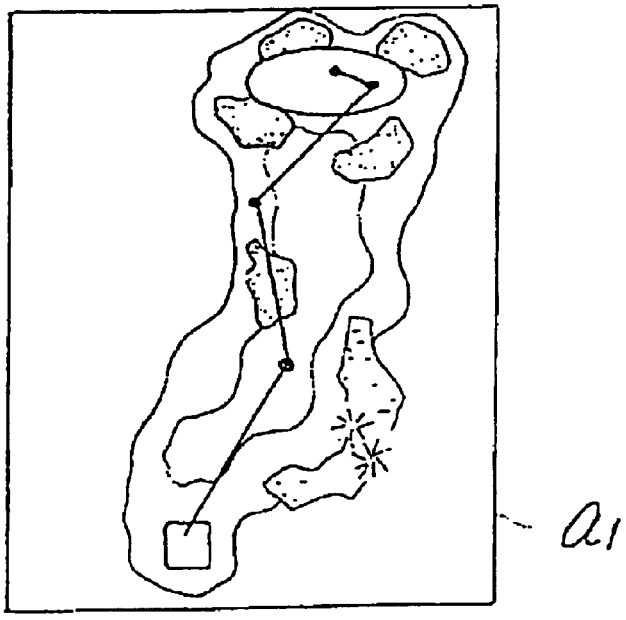
FIG. 3 is a layout of a middle or long golf course hole displayed on the terminal equipment main body.
Figure 4:
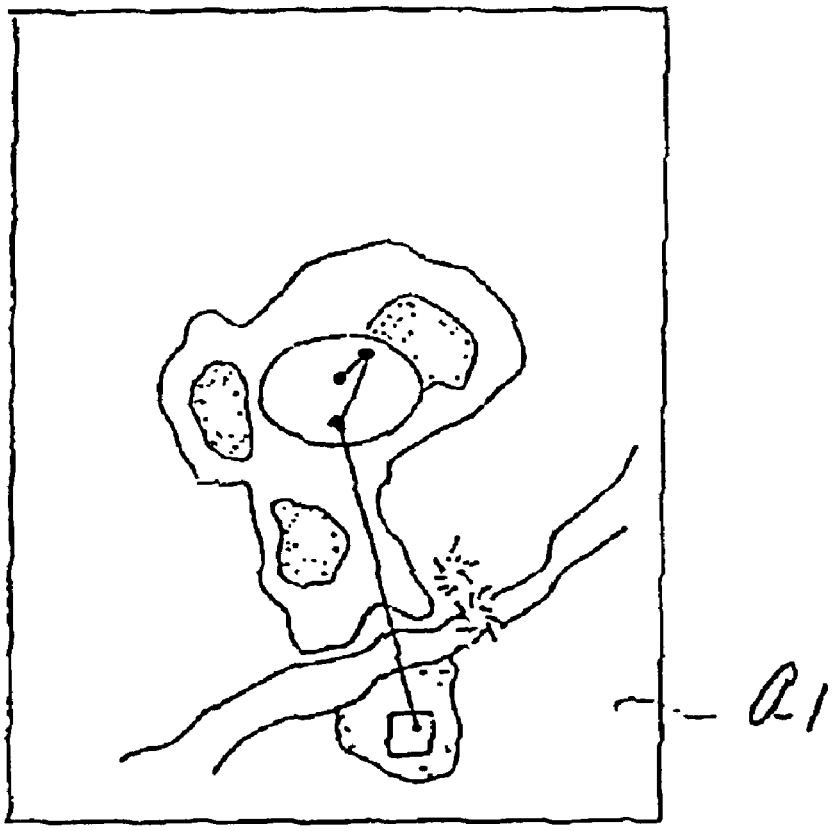
FIG. 4 is a layout of a short golf course hole.

A system of an embodiment shown in the drawing is composed of a terminal mechanism (A), as shown in FIG. 1, for imputing play scores and contents thereinto, which is carried by a golf player, a mechanism (B), as shown in FIG. 2, for analyzing the scores and contents. The mechanism (B) for analyzing the scores and the contents is composed of a dedicated cradle mechanism (b1) which is capable of loading data for a group of golf players simultaneously, a personal computer analyzing mechanism (b2) for analyzing the data inputted into the terminal mechanism (A), and an output mechanism (b3) for outputting the analyzed results of the personal computer (b2).

The terminal mechanism (A) is of a pocket size box type so as to be convenient for a golf player to carry composed of a terminal equipment (1) provided with a display section (2), which is capable of providing information such as a layout of a golf course previously inputted to the golf player, on a central portion of a surface of the terminal mechanism (A). The display means of the display section (2) will not be described in detail, but an aerial photograph and a design diagram which was prepared when the golf course was established are utilized so that layouts, such as a plan layout (a1) of individual golf courses and a sectional layout (a2) from which elevations of the whole course can be displayed. As a result, a player operates the display means or the player's position is confirmed so that the position is displayed automatically.

A selection key (7) for inputting auxiliary data, a data transmission interface (3) for electrically connecting the terminal equipment main body (1), and a dedicated cradle (5), mentioned later, are disposed below the display section (2). They are covered by a cover (4) when not in use.

In addition, the terminal equipment main body (1) is provided with an input member such as an electronic pen (6) which is necessary for a golf player to input play results. The electronic pen (6) is usually housed in the terminal equipment main body (1), and a golf player takes it out as the need arises and pushes (clicks) the display section so as to be capable of inputting (plotting).

The dedicated cradle mechanism (b1) of the analyzing mechanism (B) is composed of the dedicated cradle (5) which is capable of loading data for a group of golf players simultaneously, and the analyzing mechanism (B) can be electrically connected with the terminal mechanism (A) via the data transmission interface (3) provided to the terminal equipment (1).

In addition, the personal computer analyzing mechanism (b2) is composed of a computer main body (8) for analyzing scores, and it can collectively manage, edit and analyze the data which were electrically collected in the dedicated cradle (5).

In addition, the data which were edited and analyzed by the computer main body (8) can be outputted as information such as "table of score results of all the members" and "analyzed result of play information of a player" from the output mechanism (b3) composed of a laser printer (9) and a digital copy machine (10).

Furthermore, Web contents or the world wide web (www) is used so that the player can access the analyzed result at home. The player superposes the play scores on the display of the layout of the courses so as to visually analyze movements or to plan a strategy of golf Namely, it can be useful to improve skill.

Here, a golf player is in the course of first hole, 390 yards and par-4, and makes a first shot. As a result, the player's carry is 235 yards and the shot ball falls onto a middle portion of a fairway. At this time, since the course of the first hole viewed from above is displayed on the display section (2) of the terminal equipment main body (1), the golf player uses the electronic pen (6) to push (click) a portion of the display section corresponding to the "235"-yard fairway of the hole diagram displayed on the display section (2). As a result, the player can input (plot) a result of the first shot into the terminal equipment (1).

As an example of use of the system, the player pushes the portion of the display section corresponding to the "235"-yard fairway to input, the pushed portion is recognized by the terminal equipment (1) as an arrival point of the shot ball. However, if the golf player inputs by describing an arc to trace the portion of the display section corresponding to the "235"-yard fairway, the terminal equipment (1) calculates a center of the arc inputted by the golf player and recognizes the calculated result as the arrival position of the shot ball.

At the same time, the type of a club-driver, iron, etc.), state of lie (slanting to the right, slanting to the left, slanting to the front, slanting to the rear, etc.), swing (straight, slice, hook, fade, draw, etc.), mistake information (glance, duff (including movement of the ball), and swing and miss (not including movement of the ball), etc.) can all be inputted. The input method is simple because the electronic pen (6) is used to select from candidates displayed on the screen, and thus more detailed play results can remain as data in the terminal equipment main body (1).

As a result, the inputted data are retained in the terminal equipment main body (1) immediately, and are stored as a data base into the computer main body (8). Not shown in the drawings, but besides the hole course diagram, data bases such as a hole number, distance to the putting green and a number of par are displayed on the terminal equipment (1). It is most important that these data bases are multiplied by the data inputted by the golf player, and the multiplied data are operated and analyzed so that a carry and a residual distance are displayed as numerical values on the display section (2).

Further, in the case where the golf player is on the course except for the putting green, a total number of pars is displayed as a numerical value on the display section (2), and in the case where the golf player is on the putting green, a current number of putts is displayed as a numerical value on the display section (2). The golf player can think how to make the next shot based on the information provided by the terminal equipment main body (1).

In the next case, the golf player puts the ball onto the putting green at the second shot and aims to put the ball straight into the cup at the third shot using a putter, but the ball grazes the cup and is not put into the cup. Since the putting green has been inputted (plotted) as a drop position of the ball at the second, it is desirable that the enlarged diagram of only the putting green portion in the course on the first hole viewed from above is displayed on the display section (2) of the terminal equipment (1).

Therefore, the golf player uses the electronic pen (6) to push (click) a portion of the display section corresponding to a location where the ball stops in the putting green displayed on the display section (2). As a result, the golf player can input (plot) the result of the third shot into the terminal equipment (1). In this case, since a club which is used on the putting green is only a putter, needless to say, it is not necessary to input the type of club.

In the next case, the ball at the fourth shot falls into the cup (so called no zero). At this time, the golf player pushes (clicks) a portion of the display section (2) corresponding to a location where the ball stops on the putting green displayed on the display section (2) using the electronic pen (6) and pushes (clicks) characters "go straight into the cup" displayed on the display section (2) so as to be capable of inputting "go straight into the cup" into the terminal equipment main body (1).

When the first, second, third and fourth shots are inputted in such a manner, how the first hole was captured and what par the golf player shot are displayed as data on the display section (2) of the terminal equipment so that the data are provided to the golf player.

In addition, a mistake in input can be corrected simply when the input result is confirmed. Namely, the display section (2) is pushed (clicked) by using the electronic pen (6) according to an input guidance displayed on the display section (2) so that the input is executed. As a result, a corrected content can be inputted easily.

As for the layout displayed on the display section (2), from a viewpoint of easiness of seeing, only the layout of shorter courses such as a short hole and a middle hole are displayed. Further, a device is possible such that a longer course, i.e., a long hole can be displayed on the display section (2) by arbitrarily scrolling the long hole on the screen.

Here, the golf player shot on 9th through 18th and returned to the club house.

The data of the golf play, namely, information about the play results are stored in the terminal equipment main body (1) which was carried by the golf player. Therefore, the terminal equipment main body (1) is only inserted into the dedicated cradle (5) of the cradle mechanism (b2) via the data transmission interface (4) so that the data can be transmitted to the score analyzing system (B) on-line. As a result, the data collected in the computer (8) of the score analyzing system (B) is edited and analyzed.

The terminal equipment (1) is inserted into the dedicated cradle (5) via the transmission interface (3) so that the data about the golf play stored in the terminal equipment (1) is transmitted to the score analyzing system (B), but the transmission method is not limited to this. Namely, the data can be transmitted to the score analyzing system (B) by using an optical communication cable, a telephone line or a radio.

Furthermore, as for the data of the player, not only the play data on that day are managed and recorded, but also a success rate and the number of use of long irons for that day are calculated or when a long iron is used, a satisfaction level of the golf player, i.e., a rank of three stages A, B and C is inputted together with the play results into the terminal equipment main body (1). As a result, when the data is analyzed, an average satisfaction level is calculated and is displayed as the success rate of the results for that day, thereby attracting the great interest of the golf player.

The present invention is useful for the golf player to analyze him(her)self based on the data analyzed in such a manner.

In addition, the data, which is obtained in such a manner that the data about the golf play collected from the terminal equipment main body (1) is compared with the course information which was previously inputted into the score analyzing system (B) and is analyzed, printed by the laser printer (9) or the digital copy machine (10) so as to be capable of being provided via paper or electronic medium to the golf player immediately and easily.

Therefore, when the golf player goes home, the player can bring back a table of total scores of all members and the analyzed results of the play information which were printed on paper.

In addition, the data, which were obtained in such a manner that the data about the golf play collected from the terminal equipment (1) is compared with the course information previously inputted into the score analyzing system (B) and analyzed, is provided to the golf player via world wide web (www) and web contents, namely, they can be provided as visual information by cooperation with VTR, for example. As a result, when the golf player is in a distant place such as home, the player can plan a future strategy of golf and can make use of the present invention to improve the player's skill in golf.

The data, which was obtained in such a manner that the data about the golf play collected from the terminal equipment (1) is compared with the course information previously inputted into the score analyzing system (B) and is analyzed, can be transmitted back to the terminal equipment main body (1) via the dedicated cradle (5).

When a golf player will play on the same golf course within a few days, the returned data, namely, the data about the strategies, such that what course the player captured in the previous game, what kind of club the player used and what score the player shot, are displayed on the display section (2) of the terminal equipment (1). As a result, while carrying the terminal equipment (1), the golf player can check the data at any time so that the present invention can be useful to improve the skill in golf.

As shown in the drawing, a course map on which characteristics of the course and various memorandums, for example, are described can be provided to the terminal equipment main body (1).

What is claimed is:

1. An input terminal equipment of golf play information, comprising: a pocket-sized terminal equipment main body portable for a golf player having displaying means for displaying a plan layout of a golf course to be displayed on said terminal equipment main body and a corresponding cross-sectional layout of the golf course taken vertically showing elevations, and an input member for inputting golf play results into said terminal equipment main body.

2. An input terminal equipment of golf play information according to claim 1, wherein the input member is an electronic pen.

3. An input terminal equipment of golf play information according to claim 1, wherein the displaying means further displays an enlarged diagram of a putting green portion of the golf course after the putting green portion of the golf course is indicated by the input member.

4. An analyzing system of golf play information, comprising:

at least one pocket-sized terminal equipment main body and a respective data input member portable for a respective golf player;

a computer for editing and analyzing data loaded from said terminal equipment main body;

a cradle dedicated for loading a plurality of said terminal equipment main bodies simultaneously and collectively managing the data from said terminal equipment main bodies into said computer; and an output mechanism for outputting information edited or analyzed by said computer.

5. An analyzing system of golf score play information according to claim 4, wherein said computer is connected via a communication system with web contents so that the data edited or analyzed by said computer can be visually captured in a remote place.

6. An analyzing system of golf score play information according to claim 4, wherein said computer is connected with the world wide web (WWW) so that the data edited or analyzed by said computer can be visually captured in a remote place.

7. An analyzing system of golf score play information according to claim 4, wherein said computer is connected with the Virtual Training Repository (VTR) to retrieve visual information therein.

8. An analyzing system of golf score play information according to claim 4, wherein the input member is an electronic pen.

9. An analyzing system of golf score play information according to claim 4, wherein the displaying means further displays a corresponding cross-sectional layout of the golf course showing elevations thereof.

10. An analyzing system of golf score play information according to claim 4, wherein the computer ranks and averages play results of different players inputted via respective terminal equipment main bodies.

11. An analyzing system of golf score play information according to claim 4, wherein the output mechanism includes a printer or a copy machine.

12. An input terminal equipment of golf play information, comprising: a pocket-sized terminal equipment main body portable for a golf player having a plan layout of a golf course to be displayed on said terminal equipment main body and a hand-held electronic pen for plotting golf play results into said terminal equipment main body by clicking at an arrival position and drawing a trajectory of a golf ball on the plan layout.

13. An input terminal equipment of golf play information according to claim 12, wherein the terminal equipment main body calculates a carry or residual distance based upon information of the arrival point or the trajectory of a golf ball on the plan layout.

14. An input terminal equipment of golf play information according to claim 12, wherein the displaying means further displays an enlarged diagram of a putting green portion of the golf course after the electronic pen clicks or draws on the putting green portion of the golf course.

15. An input terminal equipment of golf play information according to claim 12, wherein the terminal equipment main body displays a corresponding cross-sectional layout of the golf course showing elevations thereof.

16. An input terminal equipment of golf play information according to claim 13, wherein the carry or the residual distance is displayed by the displaying means.

* * * * *